US011780068B2

(12) United States Patent
Yeh et al.

(10) Patent No.: US 11,780,068 B2
(45) Date of Patent: Oct. 10, 2023

(54) FASTENER DRIVING TOOL

(71) Applicant: PAO SHEN ENTERPRISES CO., LTD., Chang Hua (TW)

(72) Inventors: Sheng-Lung Yeh, Ta Sun Hsiang (TW); Chun-Man Lai, Ta Sun Hsiang (TW)

(73) Assignee: Pao Shen Enterprises Co., Ltd., Chang Hua (TW)

( * ) Notice: Subject to any disclaimer, the term of this patent is extended or adjusted under 35 U.S.C. 154(b) by 0 days.

(21) Appl. No.: 17/644,197

(22) Filed: Dec. 14, 2021

(65) Prior Publication Data

US 2023/0068249 A1 Mar. 2, 2023

(30) Foreign Application Priority Data

Aug. 27, 2021 (TW) ..... 110131900

(51) Int. Cl.
*B25C 5/11* (2006.01)

(52) U.S. Cl.
CPC ..... *B25C 5/11* (2013.01)

(58) Field of Classification Search
None
See application file for complete search history.

(56) References Cited

U.S. PATENT DOCUMENTS

2002/0108996 A1* 8/2002 Cornett ..... B25C 5/00 227/132
2009/0114696 A1* 5/2009 Chen ..... B25C 5/10 227/8
2017/0239798 A1* 8/2017 Marks ..... B25C 5/06
2019/0240823 A1* 8/2019 Lai ..... B25C 5/11
2019/0337133 A1* 11/2019 Yeh ..... F16F 1/123
2020/0346334 A1* 11/2020 Marks ..... B25C 5/11

FOREIGN PATENT DOCUMENTS

TW I641454 11/2018

* cited by examiner

*Primary Examiner* — Tanzim Imam
(74) *Attorney, Agent, or Firm* — Burris Law, PLLC

(57) ABSTRACT

A fastener driving tool includes a housing unit with a fastener striking opening, a striking member with an engaging slot, a locking member with a front engaging end detachably engaged to the engaging slot, and a handle unit pivoted on the housing unit. When the handle unit is pressed down to shift the driving tool from an initial to an energy-storing state, the locking member is driven to move the striking member away from the striking opening. When the handle unit is pressed down continuously to shift the driving tool from the energy-storing to a striking state, the front engaging end is driven to disengage from the engaging slot, and the striking member is driven to move down to the striking opening for performing a striking stroke.

6 Claims, 11 Drawing Sheets

FASTENER DRIVING TOOL

CROSS-REFERENCE TO RELATED APPLICATION

This application claims priority of Taiwanese Patent Application No. 110131900, filed on Aug. 27, 2021.

FIELD

The disclosure relates to a hand-held fastener driving tool, more particularly to a fastener driving tool that can be operated with less effort.

BACKGROUND

Referring to FIG. 1, an existing fastener driving tool 9, as disclosed in Taiwanese Patent Publication No. 1641454, includes a housing 91, a pivot axle 92 disposed in the housing 91, a handle 93 rotatably disposed on the pivot axle 92, a striking member 94 disposed on a front side of the housing 91, and a torsion spring 95 disposed in the housing 91 and located rearwardly of the striking member 94. The striking member 94 has an engaging slot 941 for a front end of the handle 93 to detachably engage therewith. The torsion spring 95 has a force-receiving rod 951 for the handle 93 to press against, and a drive rod 952 that is opposite to the force-receiving rod 951, that is inserted into the striking member 94 and that is movable along with the striking member 94.

When a rear end of the handle 93 is pressed to rotate the handle 93 relative to the pivot axle 92 from an initial state to a striking state, the front end of the handle 93, which is located on a front side of the pivot axle 92, will drive the striking member 94 to move upward along with the drive rod 952 of the torsion spring 95, while the force-receiving rod 951 of the torsion spring 95 is pressed by the handle 93 to move the force-receiving rod 951 and the drive rod 952 toward each other, so that the torsion spring 95 can store a biasing force for biasing the striking member 94 to move downward. When the handle 93 is in the striking state, the front end of the handle 93 is moved upward and away from the engaging slot 941, and the drive rod 952 drives the striking member 94 to move downward and strike a fastener (not shown).

SUMMARY

Therefore, an object of the present disclosure is to provide an improved fastener driving tool that can be operated with less effort.

According to this disclosure, a fastener driving tool includes a housing unit, a striking member, an energy-storing unit, a locking member, a handle unit, and an elastic member. The housing unit has a fastener striking opening located at a bottom of a forward end thereof, a first pivot axle located above and rearwardly of the fastener striking opening, a first fixed axle located below and forwardly of the first pivot axle, and a second fixed axle spaced apart from and located below and rearwardly of the first pivot axle and the first fixed axle. The striking member is disposed in the housing unit and is movable toward and away from the fastener striking opening in an up-down direction. The striking member has an upper portion formed with an engaging slot and a connecting slot below the engaging slot.

The energy-storing unit is disposed in the housing unit and includes a torsion spring and a return spring. The torsion spring has a coil sleeved on the second fixed axle to be twistable about the second fixed axle, a force-receiving arm extending forwardly from one end of the coil toward the striking member, a bent arm extending downwardly from one end of the force-receiving arm that is opposite to the coil and then bending inwardly, and a drive arm extending forwardly from the other end of the coil into the connecting hole of the striking member. The force-receiving arm and the drive arm are opposite to each other in the up-down direction. The bent arm is disposed under the drive arm. The return spring is disposed between the bent arm and the housing unit for biasing the bent arm upwardly. The locking member has at least one front notched portion rotatably sleeved around the first fixed axle, and a front engaging end detachably engaged to the engaging slot of the striking member. The handle unit is pivotally mounted on the housing unit for pressing down the force-receiving arm and a rear side of the locking member so as to rotate the locking member relative to the first fixed axle. The elastic member is disposed between the locking member and the handle unit for biasing the locking member toward the first fixed axle.

When the handle unit is pressed down to shift the fastener driving tool from an initial state to an energy-storing state, the force-receiving arm is pressed down by the handle unit, the locking member is driven to rotate relative to the first fixed axle, the front engaging end of the locking member is driven to move the striking member upward and away from the fastener striking opening, the striking member, in turn, drives the drive arm to move upward such that the force-receiving arm and the drive arm move toward each other and the coil stores a biasing force. When the handle unit is pressed down continuously to shift the fastener driving tool from the energy-storing state to a striking state, the front engaging end of the locking member is driven to move upward and rearward so as to disengage from the engaging slot, and the coil is freed to release the stored biasing force such that the drive arm can drive the striking member to move down to the fastener striking opening for performing a fastener striking stroke.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
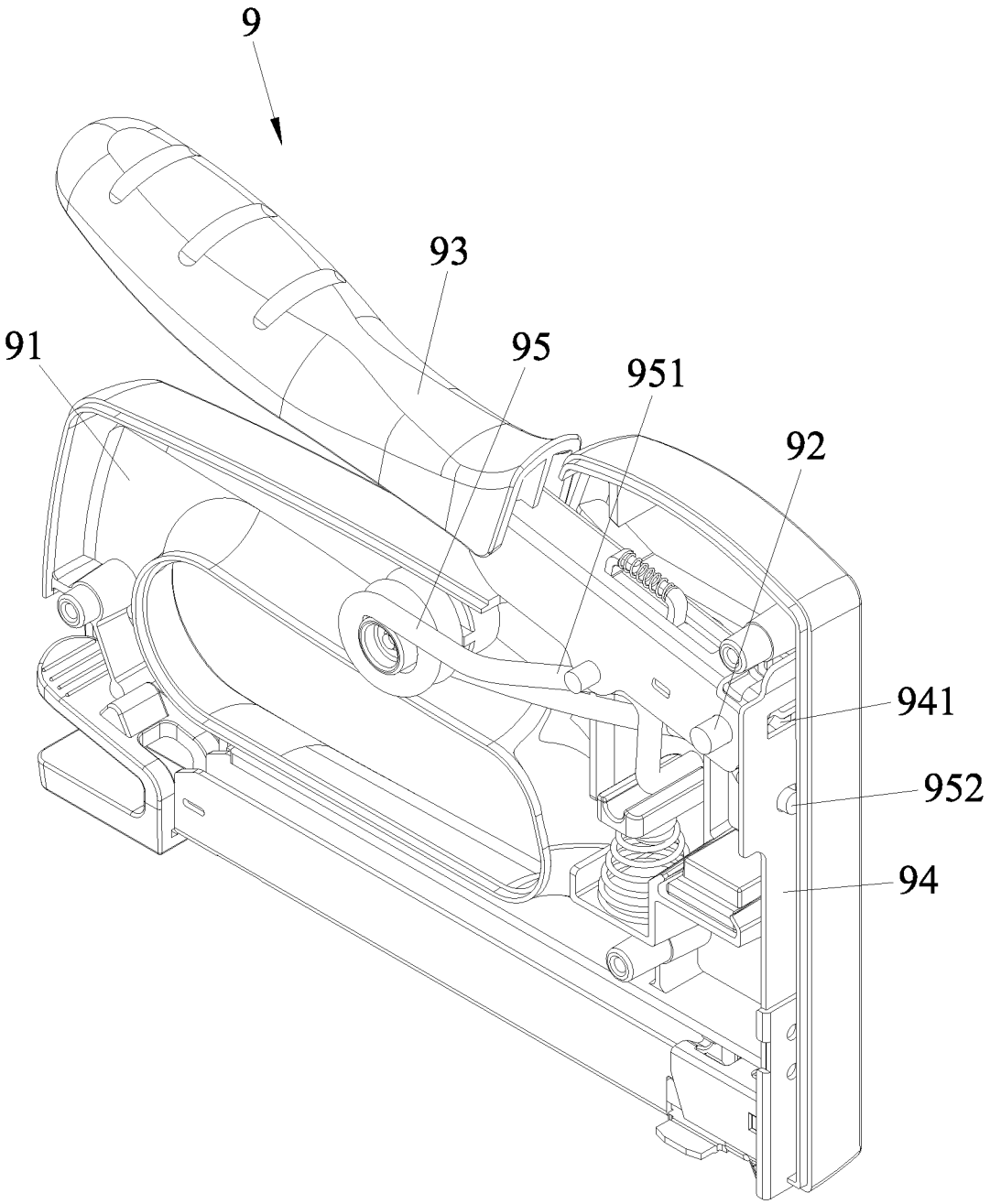
FIG.1 PRIOR ART
FIG. 1 is an incomplete perspective view of an existing fastener driving tool disclosed in Taiwanese Patent Publication No. 1641454.

Before the present disclosure is described in greater detail with reference to the accompanying drawings and embodiments, it should be noted herein that like elements are denoted by the same reference numerals throughout the disclosure.

Figure 2:
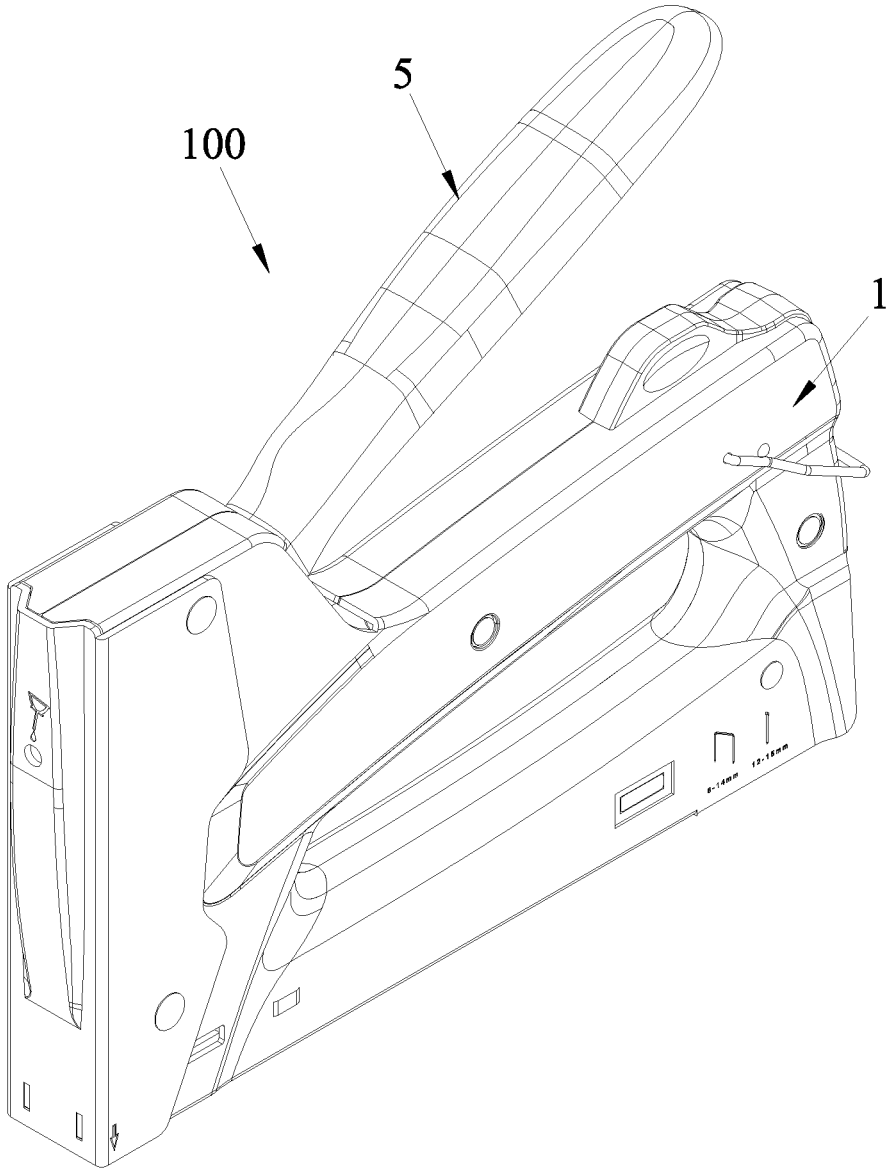
FIG. 2 is a perspective view of a fastener driving tool according to the first embodiment of the present disclosure.
Figure 3:
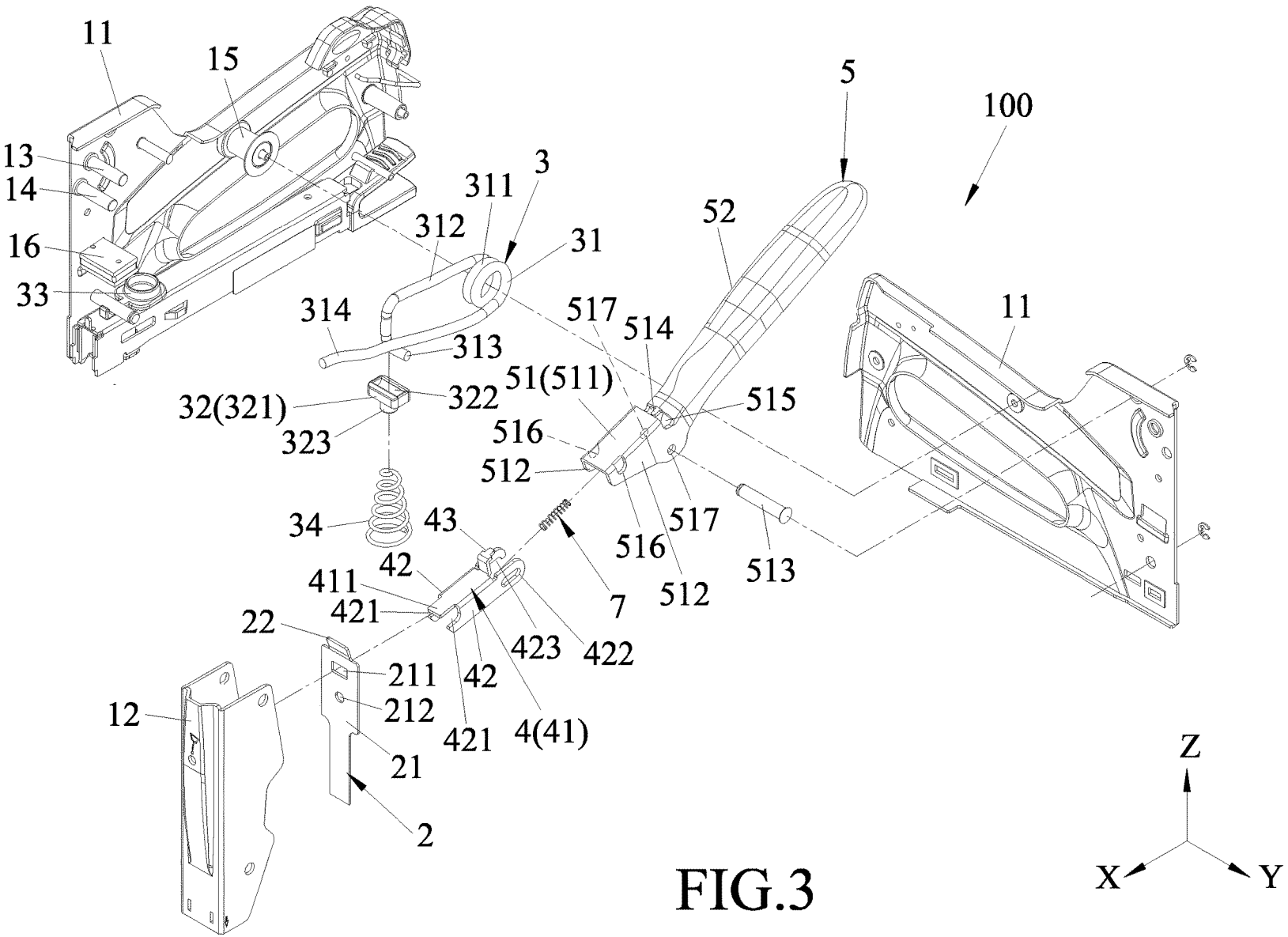
FIG. 3 is an exploded perspective view of the first embodiment.
Figure 4:
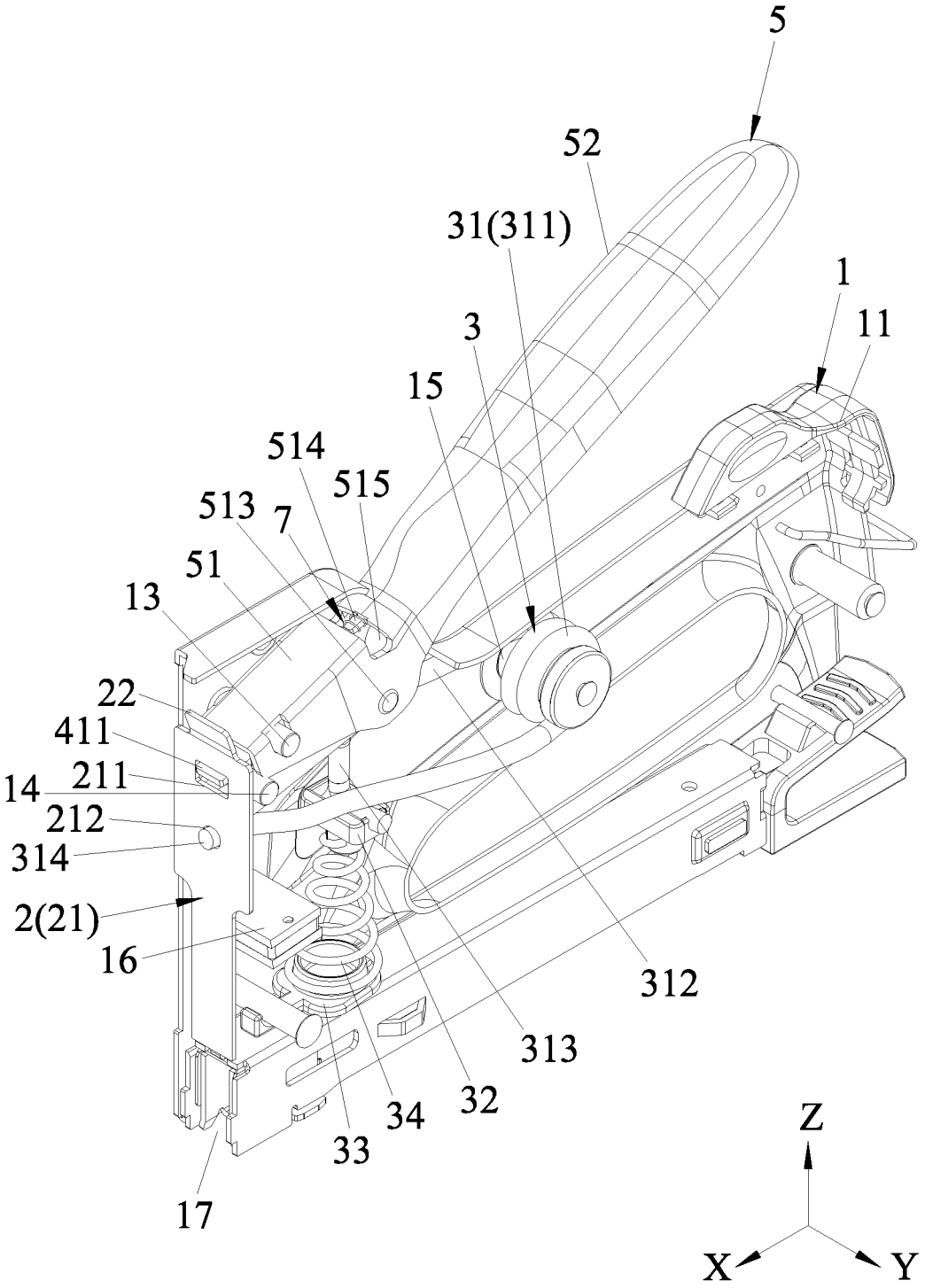
FIG. 4 is an incomplete assembled perspective view of the first embodiment.

Referring to FIGS. 2 to 4, a fastener driving tool 100 according to the first embodiment of the present disclosure is shown to include a housing unit 1, a striking member 2, an energy-storing unit 3, a locking member 4, a handle unit 5, and an elastic member 7.

The housing unit 1 includes two housing halves 11 connected to each other and extending in a front-rear direction (X), a front cover 12 connected to and covering front sides of the housing halves 11, and a first pivot axle 13, a first fixed axle 14, a second fixed axle 15 and a limiting stop 16 all disposed between the housing halves 11.

The housing halves 11 and the front cover 12 cooperatively define a fastener striking opening 17 that is adjacent to a bottom end of the front cover 12. The first pivot axle 13 extends in a left-right direction (Y), and is located above and rearwardly of the fastener striking opening 17. The first fixed axle 14 is located below and forwardly of the first pivot axle 13. The second fixed axle 15 is spaced apart from and is located below and rearwardly of the first pivot axle 13 and the first fixed axle 14. The limiting stop 16 is located between the first fixed axle 14 and the fastener striking opening 17.

The striking member 2 is movably disposed on the front cover 12 for reciprocal movement in an up-down direction (Z), and has an elongated main body 21 located above the fastener striking opening 17, and a sliding portion 22 extending upwardly from and deflected forwardly of a top end of the main body 21. The main body 21 has an upper portion formed with an engaging slot 211 extending in the left-right direction (Y) and proximate to the sliding portion 22, and a connecting hole 212 disposed below the engaging slot 211.

The energy-storing unit 3 includes a torsion spring 31, an abutment seat 32, a sleeve member 33, and a return spring 34. The torsion spring 31 has a coil 311 sleeved on the second fixed axle 15 to be twistable about the second fixed axle 15, a force-receiving arm 312 extending forwardly from one end of the coil 311 toward the striking member 2, a bent arm 313 extending downwardly from one end of the force-receiving arm 312 that is opposite to the coil 311 and then bending inwardly, and a drive arm 314 extending forwardly from the other end of the coil 311 into the connecting hole 212 of the striking member 2. The force-receiving arm 312 and the drive arm 314 are opposite to each other in the up-down direction (Z). The drive arm 314 is located above the limiting stop 16. The bent arm 313 is disposed under the drive arm 314.

The abutment seat 32 is located below the bent arm 313, and has an abutment body 321, a receiving groove 322 extending inwardly from a top surface of the abutment body 321 for receiving and supporting the bent arm 313, and a stud 323 extending downwardly from a bottom surface of the abutment body 321. The sleeve member 33 is located below the abutment seat 32. The return spring 34 has two opposite ends respectively sleeved on the stud 323 and the sleeve member 33 for biasing the bent arm 313 upwardly.

Figure 5:
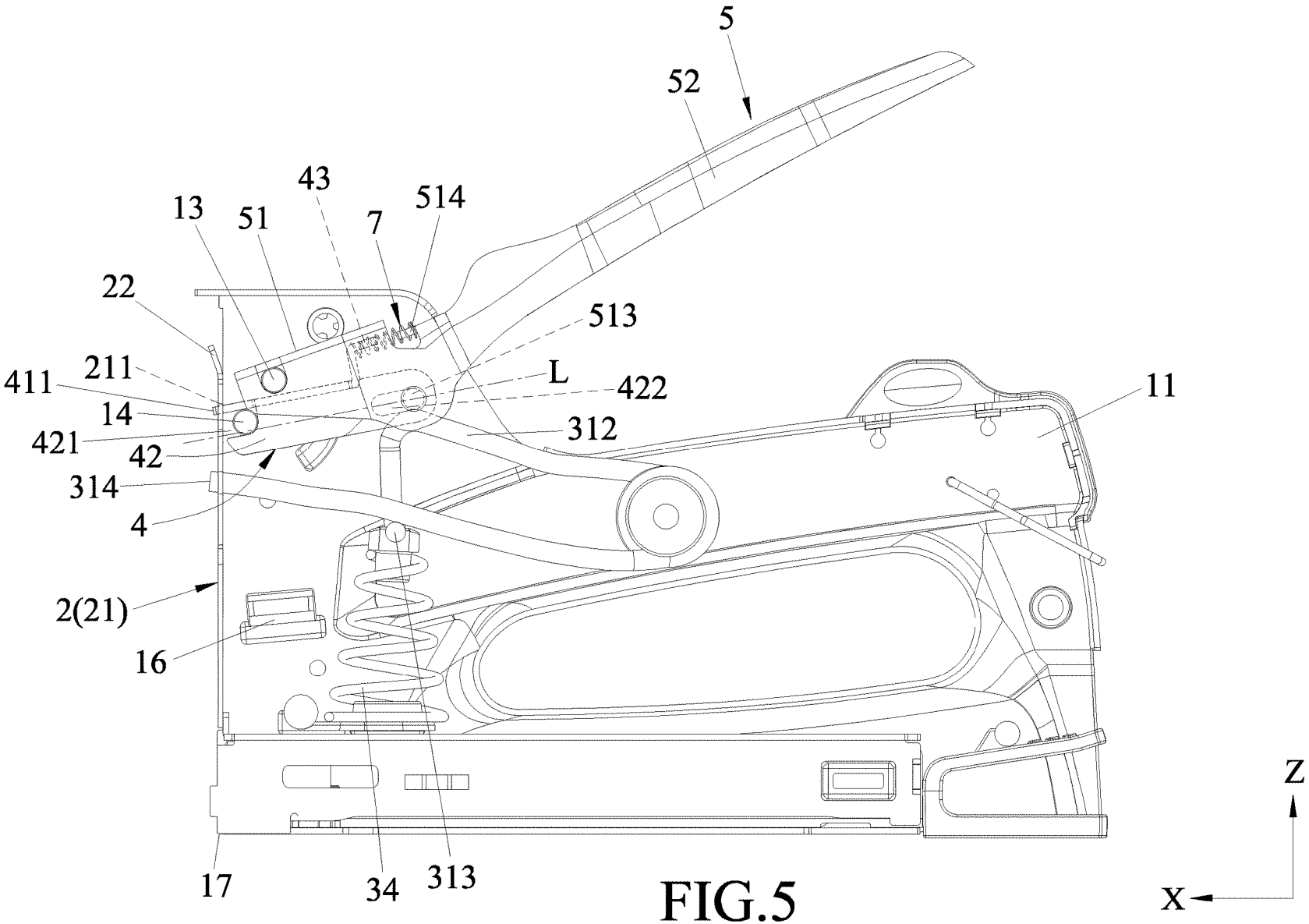
FIG. 5 is a schematic side view, illustrating the first embodiment in an initial state.

Referring to FIG. 5, in combination with FIG. 3, the locking member 4 is rotatably movable relative to the first fixed axle 14, and includes a top plate 41, and two side plates 42 extending downwardly and respectively from left and right ends of the top plate 41. The top plate 41 has a front engaging end 411 detachably engaged to the engaging slot 211 of the striking member 2, and a rear positioning piece 43 extending upwardly from a rear end of the top plate 41 and then bending rearwardly. Each side plate 42 has a front notched portion 421 opening forwardly. The front notched portions 421 of the side plates 42 are rotatably sleeved around the first fixed axle 14. In this embodiment, one of the side plates 42 has a rear end formed with a sliding slot 422 extending in the front-rear direction (X), and the other side wall 42 has an extension arm 423 extending rearwardly from a rear end thereof and terminating with a hook-shaped end. The sliding slot 422 is opposite to the front notched portion 421 in the front-rear direction (X).

It should be noted that, in other variations of this embodiment, if the locking member 4 has a block shape, there may be only one pivot notch 421 at a front end thereof and one sliding slot 422 at a rear end thereof.

The handle unit 5 includes a pressing member 51 and a handle 52.

The pressing member 51 is pivotally mounted on the first pivot axle 13, and includes a base wall 511 located above the locking member 4, two connecting walls 512 extending downwardly and respectively from left and right ends of the base wall 511, a pair of pivot holes 516 respectively formed in the connecting walls 512 in proximity to front ends thereof and adjacent to the base wall 511 for extension of the first pivot axle 13 therethrough, a pair of through holes 517 respectively formed in the connecting walls 512 and located rearwardly of the pair of pivot holes 516, and a pressing rod 513 extending through the pair of through holes 517 and the sliding slot 422 and slidable along the sliding slot 422 along the front-rear direction (X). The extension arm 423 is hooked onto the pressing rod 513. The pressing rod 513 is fixed to the connecting walls 512 and is used for pressing down the force-receiving arm 312 of the torsion spring 31 and a rear side of the locking member 4 so as to rotate the locking member 4 relative to the first fixed axle 14.

The handle 52 extends rearwardly from rear ends of the connecting walls 512, and cooperates with the base wall 511 and the connecting walls 512 to define a through slot 515. A protruding piece 514 extends from a front end of the handle 52 toward the through slot 515. In this embodiment, the handle 52 is long, and has a downward curved shape.

The elastic member 7 is a compression spring, and has two opposite ends respectively sleeved on the rear positioning piece 43 of the locking member 4 and the protruding piece 514 of the handle unit 5 for biasing the locking member 4 toward the first fixed axle 14.

Figure 6:
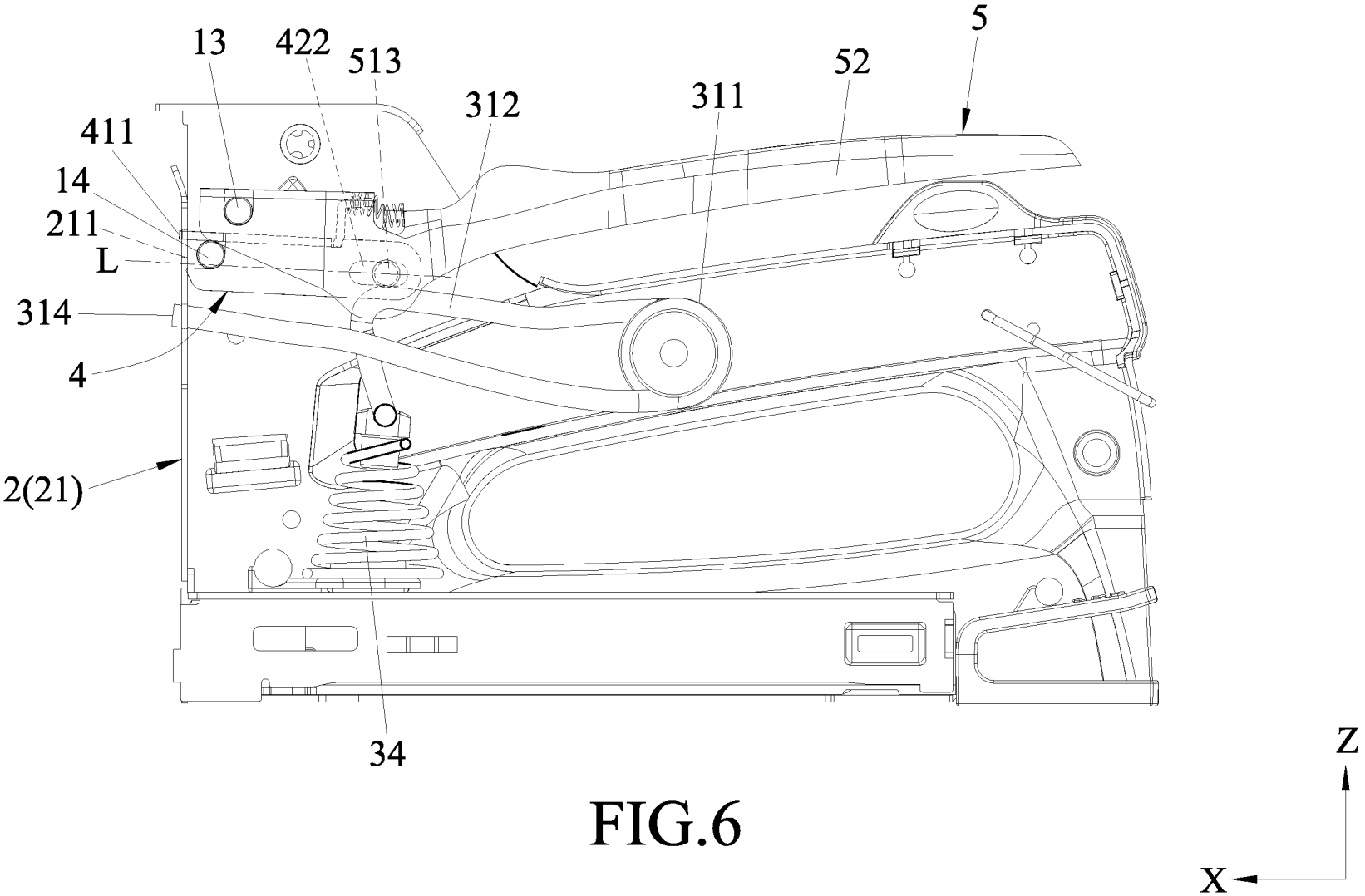
FIG. 6 is a view similar to FIG. 5, but illustrating the first embodiment in an energy-storing state.
Figure 7:
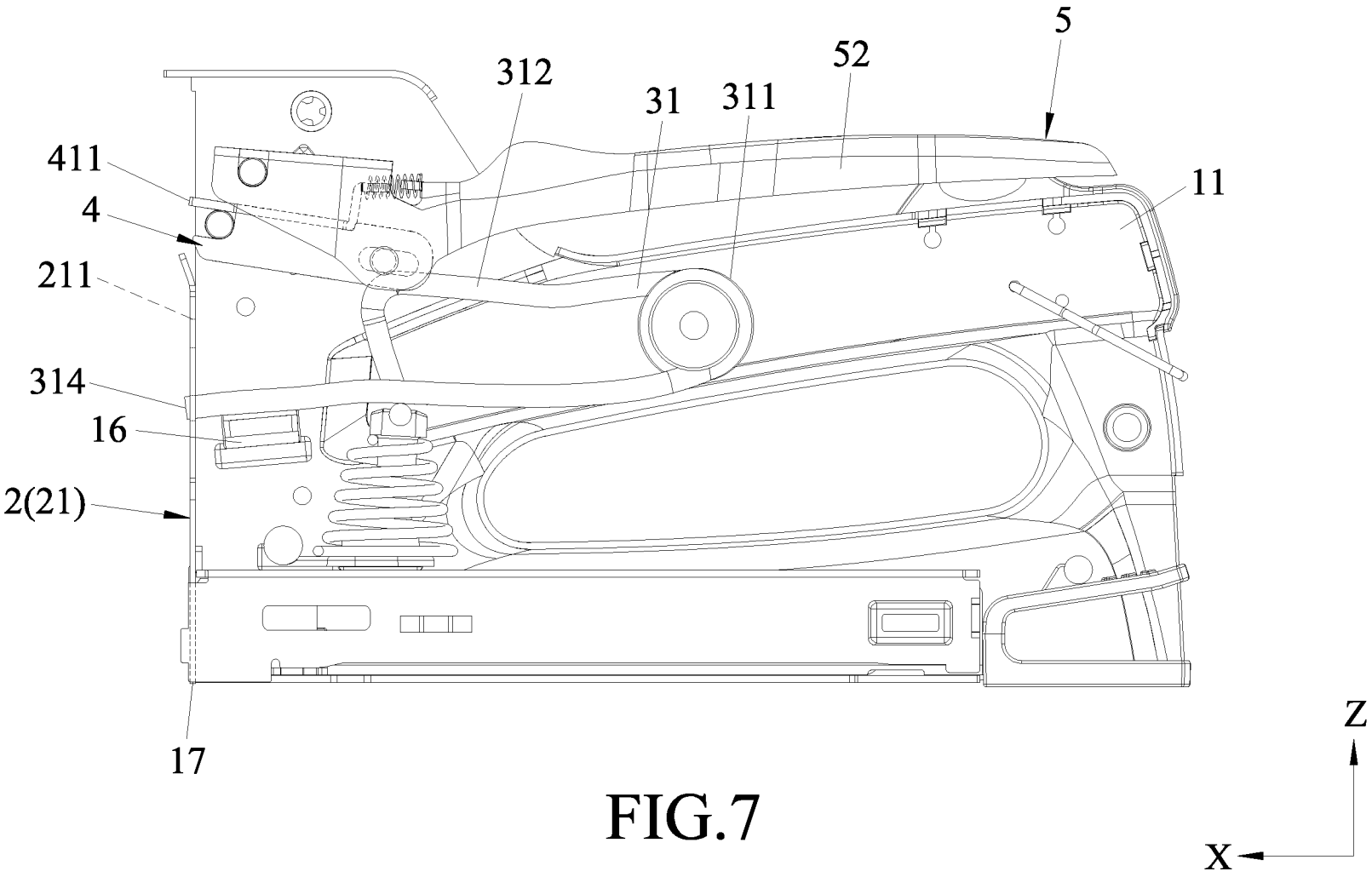
FIG. 7 is a view similar to FIG. 6, but illustrating the first embodiment in a striking state.

Referring to FIGS. 6 and 7, in combination with FIG. 5, the fastener driving tool 100 of this disclosure is movable among an initial state (see FIG. 5), an energy-storing state (see FIG. 6), and a striking state (see FIG. 7).

As shown in FIG. 5, when the fastener driving tool 100 is in the initial state, a bottom end of the main body 21 of the striking member 2 is proximate to the fastener striking opening 17, the front engaging end 411 of the locking member 4 is engaged to the engaging slot 211, the drive arm 314 is away from the limiting stop 16, and a rear side of the handle 52 is away from the housing halves 11.

As shown in FIG. 6, when the handle 52 is pressed to shift the fastener driving tool 100 from the initial state to the energy-storing state, the force-receiving arm 312 is pressed down by the pressing rod 513, the return spring 34 is compressed by the bent arm 313 to store a return force, the locking member 4 is driven by the pressing rod 513 to rotate relative to the first fixed axle 14, and the pressing rod 513 is driven to slide forwardly along the sliding slot 422. Further, the front engaging end 411 of the locking member 4 is driven to move the striking member 2 upward and away from the fastener striking opening 17, and the striking member 2, in turn, drives the drive arm 314 to move upward such that the force-receiving arm 312 and the drive arm 314 of the torsion spring 31 move toward each other, so that the coil 311 of the torsion spring 31 stores a biasing force.

With reference to FIGS. 6 and 7, when the handle 52 is pressed down continuously to shift the fastener driving tool 100 from the energy-storing state to the striking state, the front engaging end 411 of the locking member 4 is driven to move upward and rearward so as to disengage from the engaging slot 211, and the coil 311 is freed to release the stored biasing force, so that the drive arm 314 can drive the striking member 2 to move down to the fastener striking opening 17 and strike a fastener (not shown) located at the fastener striking opening 17. At this state, the bottom end of the main body 21 of the striking member 2 is located at the fastener striking opening 17, the front engaging end 411 of the locking member 4 is away from the engaging slot 211, the drive arm 314 abuts against and is limited by the limiting stop 16, and the rear side of the handle 52 is proximate to the housing halves 11.

Figure 8:
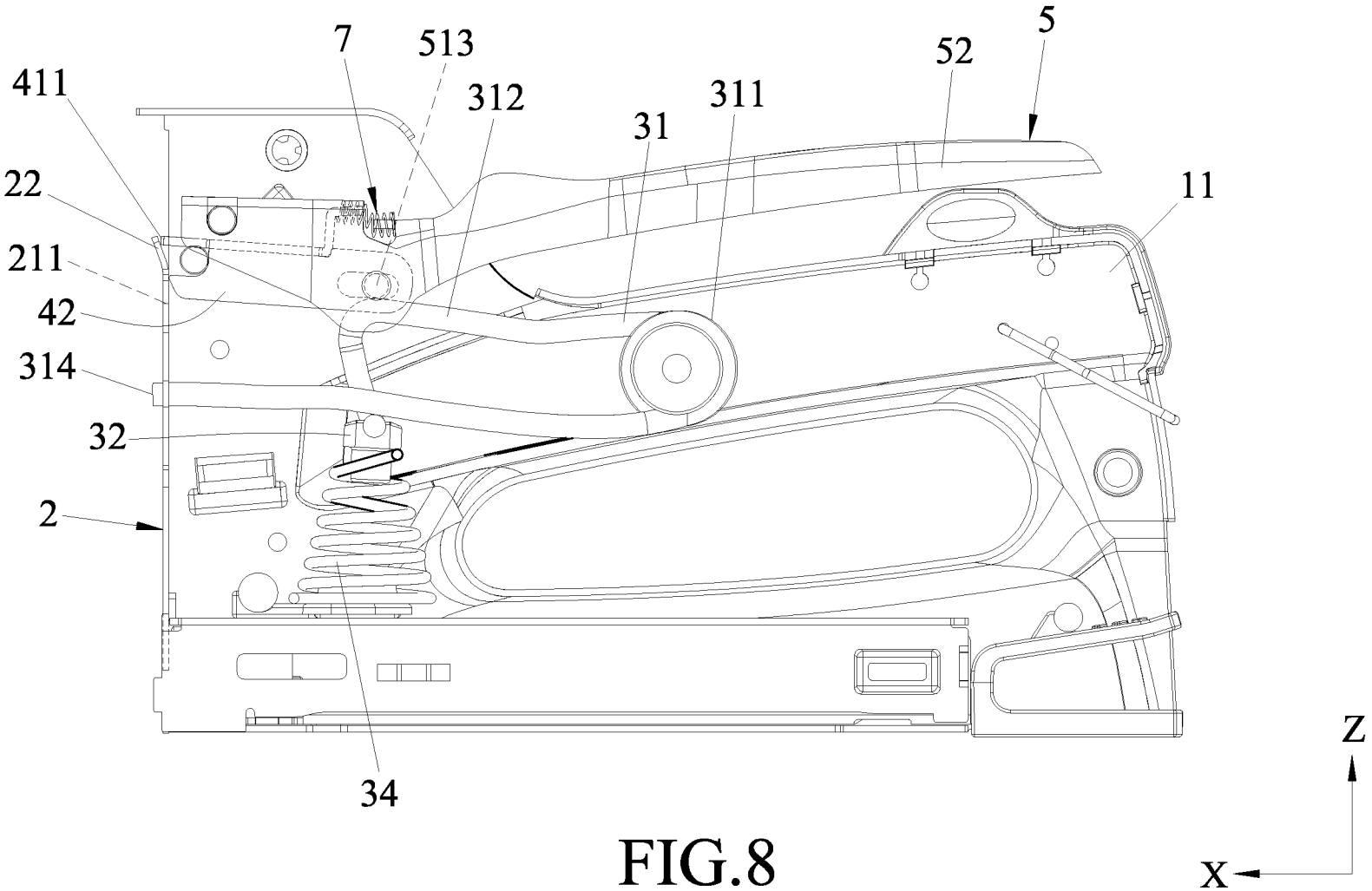
FIG. 8 is a view similar to FIG. 7, but illustrating how the first embodiment is moved from the striking state to the initial state.

Referring to FIG. 8, in combination with FIG. 5, when the handle 52 is released from being pressed to shift the fastener driving tool 100 from the striking state to the initial state, the return spring 34 is freed to release the stored return force so as to urge the force-receiving arm 312 and the drive arm 314 of the torsion spring 31 upwardly. The upward movement of the force-receiving arm 312, in turn, drives the pressing rod 513 to slide rearward along the sliding slot 422, thereby pivoting the pressing member 51 about the first pivot axle 13 to move the rear side of the handle 52 upwardly and away from the housing halves 11, and thereby rotating the locking member 4 about the first fixed axle 14 to move downward the front engaging end 411 toward the sliding portion 22 of the striking member 2. Further, the drive arm 314 drives the striking member 2 to move upward. When the front engaging end 411 of the locking member 4 abuts against the sliding portion 22 of the striking member 2, the elastic member 7 is compressed between the locking member 4 and the handle 52. As the front engaging end 411 moves downward along the sliding portion 22 into the engaging slot 211, the elastic member 7 biases the locking member 4 to engage the front engaging end 411 with the engaging slot 211.

The fastener driving tool 100 of this disclosure mainly uses the handle unit 5 to press the force-receiving arm 312 and cause the coil 311 to store a biasing force. Then, the locking member 4 is driven to rotate so as to disengage the front engaging end 411 thereof from the engaging slot 211 of the striking member 2, so that the striking member 2 can move downward for performing a fastener striking stroke. However, in order to drive rotation of the locking member 4 so as to move the front engaging end 411 thereof upward and rearward during pressing of the handle 52, the force for pulling down the front engaging end 411 by the striking member 2, which is driven by the drive arm 314, must be overcome. Extra effort must thus be exerted by a user. Therefore, with the first fixed axle 14 being more proximate to the striking member 2 than the first pivot axle 13, during rotation of the locking member 4, it is only necessary to lift the striking member 2 a short distance so as to separate the front engaging end 411 from the striking member 2, thereby reducing the upward movement of the striking member 2 during pressing. The effect of saving labor and effort can thus be achieved.

Moreover, during pressing of the handle 52, the force for pushing upward the pressing rod 513 by the force-receiving arm 312 must also be overcome. The force of the force-receiving arm 312 for pushing upward the pressing rod 513 can be indirectly acted on the first fixed axle 14 by the side plates 42 of the locking member 4 and can be indirectly acted on the first pivot axle 13 by the connecting walls 512 of the pressing member 51 to reduce the force required for pressing the handle 52. Hence, the purpose of labor-saving operation of this disclosure can indeed be achieved.

Figure 9:
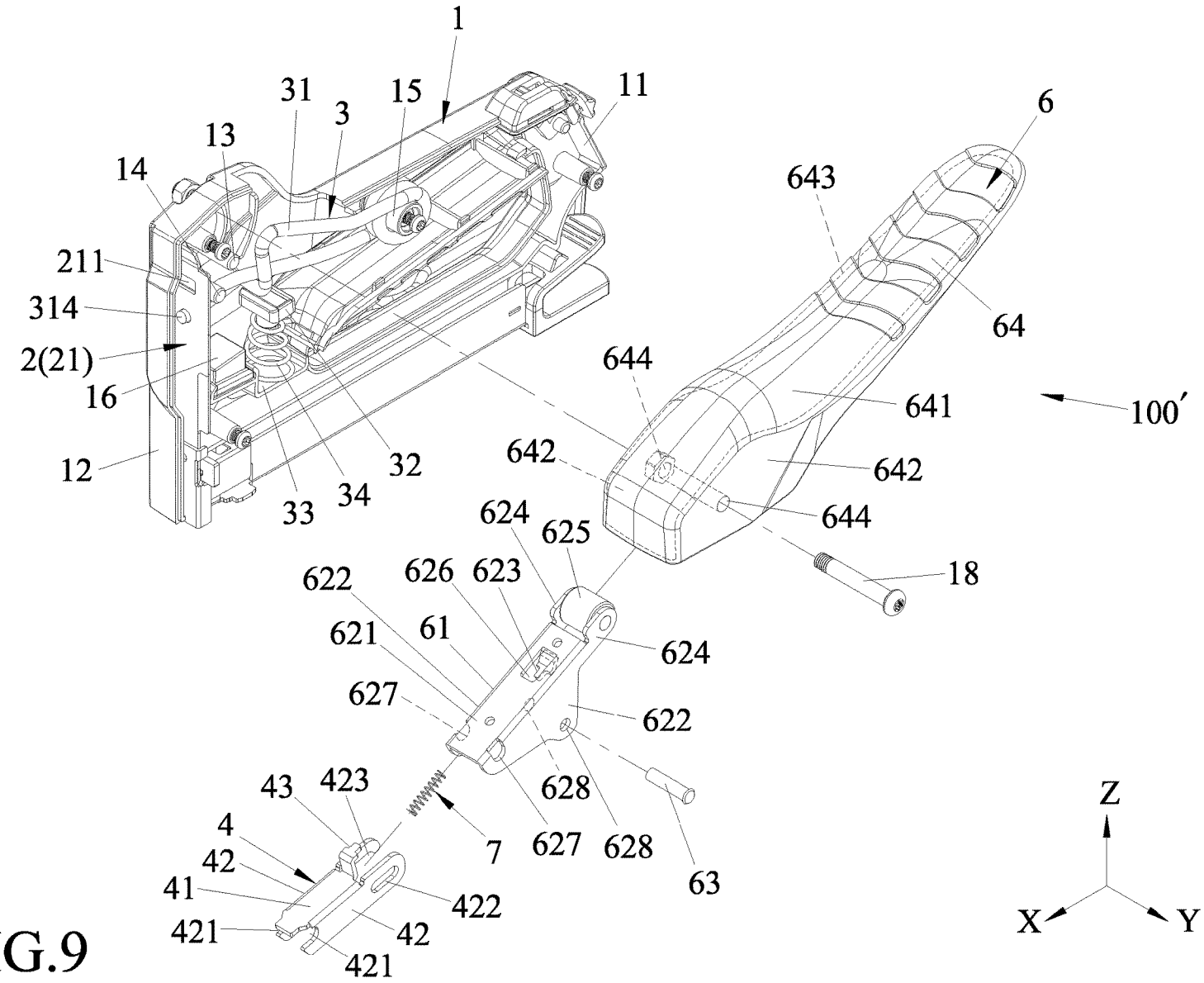
FIG. 9 is an incomplete exploded perspective view of a fastener driving tool according to the second embodiment of the present disclosure.
Figure 10:
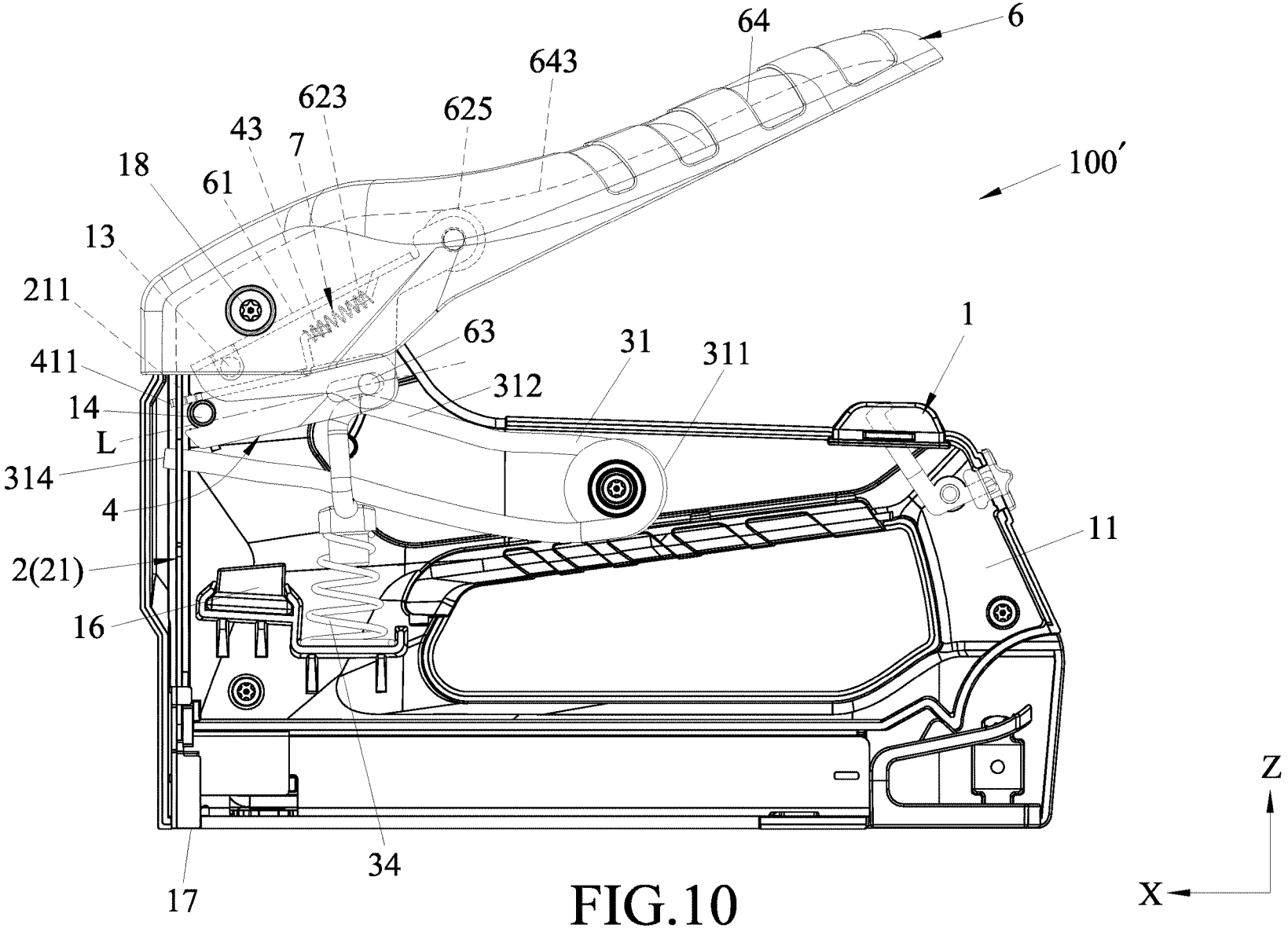
FIG. 10 is a schematic side view, illustrating the second embodiment in an initial state.
Figure 11:
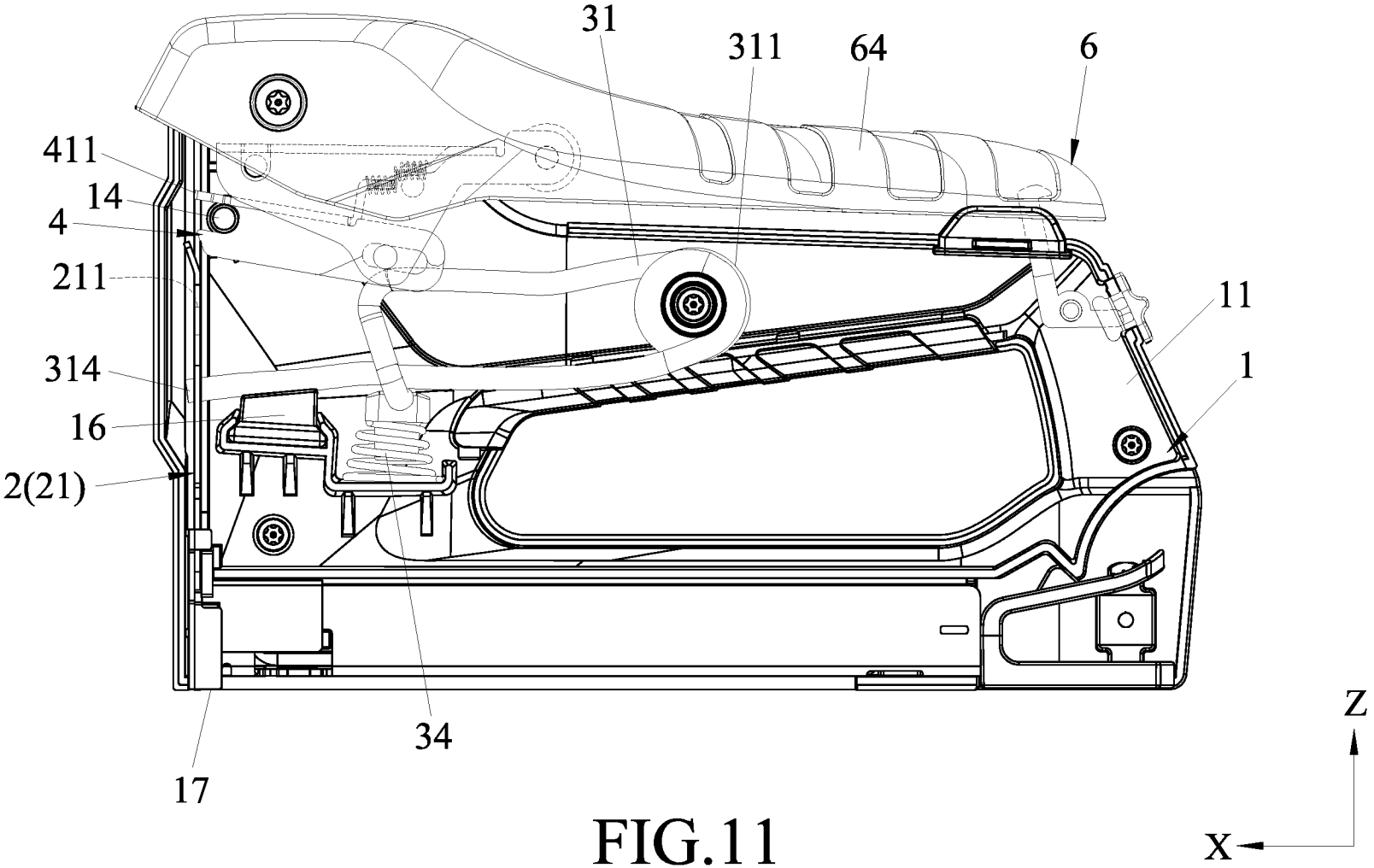
FIG. 11 is a view similar to FIG. 10, but illustrating the second embodiment in a striking state.

Referring to FIGS. 9 to 11, the second embodiment of the fastener driving tool 100' of this disclosure is identical to the first embodiment, and differs in that, in this embodiment, the front cover 12 is integrally connected to the housing halves 11 (only one housing half 11 is shown), and the housing unit 1 further includes a second pivot axle 18 located above the first pivot axle 13. The pressing member 61 of the handle unit 6 further includes two pivot connecting walls 624 extending rearwardly and respectively from rear ends of the connecting walls 622 thereof, and a roller 625 pivoted between the pivot connecting walls 624. The base wall 621 of the pressing member 61 has a through slot 626 extending in the front-rear direction (X). The protruding piece 623 of the handle unit 6 extends downwardly and forwardly from a rear edge of the through slot 626.

The handle 64 of the handle unit 6 is pivotally mounted on the second pivot axle 18 to press down the pressing member 61 of the handle unit 6 so as to rotate the pressing member 61 relative to the first pivot axle 13. The handle 64 includes a handle main wall 641, and two extension walls 642 extending downwardly and respectively from left and right front end portions of the handle main wall 641, and a pair of pivot holes 644 respectively formed in the extension walls 642 for receiving the second pivot axle 18. The handle main wall 641 has an inner wall surface 643 that has a concave shape opening downward and that abuts against the roller 625. The roller 625 is rotatable relative to the inner wall surface 643.

The two opposite ends of the elastic member 7 are respectively sleeved on the rear positioning piece 43 of the locking member 4 and the protruding piece 623 for biasing the locking member 4 to move toward the first fixed axle 14.

With reference to FIG. 10, when the fastener driving tool 100' is in the initial state, a bottom end of the main body 21 of the striking member 2 is proximate to the fastener striking opening 17, the front engaging end 411 of the locking member 4 is engaged to the engaging slot 211, the drive arm 314 is away from the limiting stop 16, and a rear side of the handle 64 is away from the housing halves 11 (only one housing half 11 is shown).

When the fastener driving tool 100' is in the energy-storing state, the operating relationship of the locking member 4, the striking member 2 and the torsion spring 31 is similar to that described in the first embodiment. Referring again to FIG. 6, in combination with FIG. 10, when the handle 64 is pressed to shift the fastener driving tool 100' from the initial state to the energy-storing state, the roller 625 is driven to rotate relative to the inner wall surface 643 of the handle 64, the pressing rod 63 of the pressing member 61 is driven to press down the force-receiving arm 312 of the torsion spring 31, and the locking member 4 is driven by the pressing rod 63 to rotate relative to the first fixed axle 14. Further, the front engaging end 411 of the locking member 4 drives the striking member 2 to move upward and away from the fastener striking opening 17. The striking member 2, in turn, drives the drive arm 314 to move upward such that the force-receiving arm 312 and the drive arm 314 of the torsion spring 31 move toward each other, so that the coil 311 of the torsion spring 31 stores a biasing force.

When the handle 64 is pressed continuously to shift the fastener driving tool 100' from the energy-storing state to the striking state, as shown in FIG. 11, the front engaging end 411 of the locking member 4 is driven to move upward to disengage from the engaging slot 211 of the striking member 2, while the coil 311 of the torsion spring 31 is freed to release the stored biasing force, so that the drive arm 314 can drive the striking member 2 to move down to the fastener striking opening 17 for performing a fastener striking stroke. At this state, the bottom end of the main body 21 of the striking member 2 is located at the fastener striking opening 17, the front engaging end 411 of the locking member 4 is disengaged from the engaging slot 211, the drive arm 314 abuts against the limiting stop 16, and a rear side of the handle 64 is proximate to the housing halves 11 (only one housing half 11 is shown).

To shift the fastener driving tool 100' from the striking state to the initial state, the operating relationship of the locking member 4 and the striking member 2 is similar to that described in the first embodiment, so that a detailed description thereof is omitted herein.

During pressing of the handle 64, since the first fixed axle 14 is more proximate to the striking member 2 than the first pivot axle 13, the striking member 2 is only lifted a short distance during rotation of the locking member 4 to separate the front engaging end 411 from the striking member 2. Thus, because the upward movement of the striking member 2 can be reduced, the effort for pressing the handle 64 can also be reduced.

Further, during pressing of the handle 64, the force of the force-receiving arm 312 for pushing upward the pressing rod 63 can be indirectly acted on the fixed pivot 14 by the side plates 42 of the locking member 4, can be indirectly acted on the first pivot axle 13 by the connecting walls 622 of the pressing member 61, and can be indirectly acted on the second pivot axle 18 by the extension walls 642 of the handle 64, so that the force for pressing the handle 64 can be reduced.

In summary, the first and second embodiments of this disclosure can indeed achieve the purpose of operating this disclosure with less effort.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A fastener driving tool comprising:

a housing unit having a fastener striking opening located at a bottom of a forward end thereof, a first pivot axle located above and rearwardly of said fastener striking opening, a first fixed axle located below and forwardly of said first pivot axle, and a second fixed axle spaced apart from and located below and rearwardly of said first pivot axle and said first fixed axle;

a striking member disposed in said housing unit and movable toward and away from said fastener striking opening in an up-down direction, said striking member having an upper portion formed with an engaging slot and a connecting slot below said engaging slot;

an energy-storing unit disposed in said housing unit and including a torsion spring and a return spring, said torsion spring having a coil sleeved on said second fixed axle to be twistable about said second fixed axle, a force-receiving arm extending forwardly from one end of said coil toward said striking member, a bent arm extending downwardly from one end of said force-receiving arm that is opposite to said coil and then bending inwardly, and a drive arm extending forwardly from the other end of said coil into said connecting slot of said striking member, said force-receiving arm and said drive arm being opposite to each other in the up-down direction, said bent arm being disposed under said drive arm, said return spring being disposed between said bent arm and said housing unit for biasing said bent arm upwardly;

a locking member having at least one front notched portion rotatably sleeved around said first fixed axle, and a front engaging end detachably engaged to said engaging slot of said striking member;

a handle unit pivotally mounted on said first pivot axle for pressing down said force-receiving arm and a rear side of said locking member so as to rotate said locking member relative to said first fixed axle; and an elastic member disposed between said locking member and said handle unit for biasing said locking member toward said first fixed axle;

wherein, when said handle unit is pressed down to shift said fastener driving tool from an initial state to an energy-storing state, said force-receiving arm is pressed down by said handle unit, said locking member is driven to rotate relative to said first fixed axle, said front engaging end of said locking member is driven to move said striking member upward and away from said fastener striking opening, said striking member, in turn, drives said drive arm to move upward such that said force-receiving arm and said drive arm move toward each other and said coil stores a biasing force;

wherein, when said handle unit is pressed down continuously to shift said fastener driving tool from said energy-storing state to a striking state, said front engaging end of said locking member is driven to move upward and rearward so as to disengage from said engaging slot, and said coil is freed to release the stored biasing force such that said drive arm can drive said striking member to move down to said fastener striking opening for performing a fastener striking stroke.

2. The fastener driving tool as claimed in claim 1, wherein said handle unit includes a pressing member pivotally mounted on said first pivot axle, said pressing member including a pressing rod extending through said rear side of said locking member for pressing down said force-receiving arm and said rear side of said locking member.

3. The fastener driving tool as claimed in claim 2, wherein said locking member further has a sliding slot provided on said rear side and extending in a front-rear direction, said sliding slot being opposite to said at least one front notched portion in the front-rear direction, said pressing rod extending through said sliding slot and being slidable in said sliding slot along the front-rear direction.

4. The fastener driving tool as claimed in claim 3, wherein said housing unit further has a second pivot axle located above said first pivot axle, said handle unit further including a handle pivotally mounted on said second pivot axle to press down said pressing member so as to rotate said pressing member relative to said first pivot axle, said elastic member being disposed between said locking member and said pressing member, and wherein said pressing member is driven by said handle to press down said force-receiving arm and said locking member is driven by said pressing member to rotate relative to said first fixed axle when said handle is pressed down to shift said fastener driving tool from said initial state to said energy-storing state.

5. The fastener driving tool as claimed in claim 4, wherein said pressing member further includes two pivot connecting walls extending rearwardly from a rear side thereof, and a roller pivoted between said pivot connecting walls for pressing by said handle, said roller being rotatable relative to said handle.

6. The fastener driving tool as claimed in claim 5, wherein said handle has an inner wall surface that has a concave shape opening downward and that abuts against said roller.

* * * * *